US006425710B1

(12) United States Patent
Khachaturian

(10) Patent No.: US 6,425,710 B1
(45) Date of Patent: Jul. 30, 2002

(54) ARTICULATED MULTIPLE BUOY MARINE PLATFORM APPARATUS

(76) Inventor: Jon Khachaturian, 5427 Sutton Pl., New Orleans, LA (US) 70131

( * ) Notice: Subject to any disclaimer, the term of this patent is extended or adjusted under 35 U.S.C. 154(b) by 0 days.

(21) Appl. No.: 09/693,470

(22) Filed: Oct. 20, 2000

Related U.S. Application Data

(60) Provisional application No. 60/213,034, filed on Jun. 21, 2000.

(51) Int. Cl.[7] ..... E02D 17/08

(52) U.S. Cl. ..... 405/202; 405/200; 405/206

(58) Field of Search ..... 405/202, 209, 405/224, 224.2, 195.1, 200; 64/46.5; 403/24

(56) References Cited

U.S. PATENT DOCUMENTS

| | | | | |
|---|---|---|---|---|
| 3,519,036 A | | 7/1970 | Manning | |
| 3,708,985 A | | 1/1973 | Pogonowski | |
| 3,736,756 A | * | 6/1973 | Lloyd | 64/46.5 |
| 4,026,119 A | | 5/1977 | Dotti | |
| 4,106,146 A | | 8/1978 | Maari | |
| 4,155,670 A | * | 5/1979 | Stafford | 405/202 |
| 4,249,618 A | | 2/1981 | Lamy | |
| 4,436,454 A | | 3/1984 | Ninet et al. | |
| 4,470,723 A | * | 9/1984 | Michel et al. | 405/202 |
| 4,674,918 A | | 6/1987 | Kalpins | |
| 4,702,321 A | | 10/1987 | Horton | |
| 4,714,382 A | * | 12/1987 | Khachaturian | 405/204 |
| 4,733,991 A | | 3/1988 | Myers | |
| 4,913,238 A | | 4/1990 | Danazcko et al. | |
| 4,930,924 A | * | 6/1990 | Hunt | 403/24 |
| 4,930,938 A | | 6/1990 | Rawstron et al. | |
| 4,966,495 A | * | 10/1990 | Goldman | 405/224 |
| 5,403,124 A | | 4/1995 | Kocaman et al. | |
| 5,443,330 A | * | 8/1995 | Copple | 405/224.2 |
| 5,542,783 A | | 8/1996 | Pollack | |
| 5,553,977 A | * | 9/1996 | Andersen et al. | 405/204 |
| 5,846,028 A | * | 12/1998 | Thory | 405/195.1 |
| 5,931,602 A | * | 8/1999 | Gulbrandsen et al. | 405/224 |
| 6,149,350 A | | 11/2000 | Khachaturian | |
| 6,171,028 B1 | | 1/2001 | Van Gelder | |

OTHER PUBLICATIONS

2000 Worldwide Survey of Deepwater Production Solutions, Offshore Magazine, Sep. 2000.

* cited by examiner

*Primary Examiner*—Thomas B. Will
*Assistant Examiner*—Raymond W Addie
(74) *Attorney, Agent, or Firm*—Garvey, Smith, Nehrbass & Doody, LLC; Charles C. Garvey, Jr.

(57) ABSTRACT

A marine platform provides a plurality of buoys, a platform having a peripheral portion that includes a plurality of attachment positions, one attachment position for each buoy, and an articulating connection that connects each buoy to the platform at a respective attachment position, the connection allowing for sea state induced buoy motions while minimizing effect on the platform.

68 Claims, 10 Drawing Sheets

ARTICULATED MULTIPLE BUOY MARINE PLATFORM APPARATUS

CROSS-REFERENCE TO RELATED APPLICATIONS

Priority of U.S. Provisional patent application Ser. No. 60/213,034, filed Jun. 21, 2000, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to floating marine platforms. More particularly, the present invention relates to a novel multiple buoy platform that supports a platform with a plurality of buoys and wherein articulating connections form an interface between the platform and the buoys.

2. General Background of the Invention

Many types of marine platforms have been designed, patented and used commercially. Marine platforms typically take the form of either fixed platforms that include a large underwater support structure or "jacket" or a floating platform having a submersible support. Sometimes these platforms are called semi-submersible rigs.

Jack-up barges are another type of platform that can be used in an offshore marine environment for drilling/production. Jack-up barges have a barge with long legs that can be powered up for travel and powered down to elevate the barge above the water.

Other types of platforms for deep water (1500 feet or deeper) have been patented. The September 2000 issue of Offshore Magazine shows many floating offshore platforms for use in deep water drilling and/or production. Some of the following patents relate to offshore platforms, some of which are buoy type offshore platforms, all of which are hereby incorporated herein by reference. Other patents have issued that relate in general to floating structures, and include some patents disclosing structures that would not be suitable for use in oil and gas well drilling and/or production.

| PATENT # | ISSUE DATE | TITLE |
|---|---|---|
| 3,540,396 | 11/17/70 | Offshore Well Apparatus and System |
| 4,297,965 | 11/03/81 | Tension leg Structure for Tension Leg Platform |
| 5,439,060 | 08/08/95 | Tensioned Riser Deepwater Tower |
| 5,558,467 | 09/24,96 | Deep Water offshore Apparatus |
| 5,706,897 | 01/13/98 | Drilling, Production, Test, and Oil Storage Caisson |
| 5,722,797 | 03/03/98 | Floating Caisson for Offshore Production and Drilling |
| 5,873,416 | 02/23/99 | Drilling, Production, Test, and Oil Storage Caisson |
| 5,924,822 | 07/20/99 | Method for Deck Installation on an Offshore Substructure |

-continued

| PATENT # | ISSUE DATE | TITLE |
|---|---|---|
| 6,012,873 | 01/11/00 | Buoyant Leg Platform With Retractable Gravity Base and Method of Anchoring and Relocating the Same |
| 6,027,286 | 02/22/00 | Offshore Spar Production System and Method for Creating a Controlled Tilt of the Caisson Axis |

One of the problems with the spar type construction is that the single spar must be enormous and thus very expensive to manufacture, transport, and install if it is supporting a drilling rig or production platform weighing between 5,000 and 40,000 tons, for example (or even a package of between 500–100,000 tons).

BRIEF SUMMARY OF THE INVENTION

The present invention provides an improved offshore marine platform that can be used for drilling for oil and/or gas or in the production of oil and gas from an offshore environment. Such drilling and/or production facilities typically weigh between 500–100,000 tons, more commonly between 3,000–50,000 tons.

The apparatus of the present invention thus provides a marine platform that is comprised of a plurality of spaced apart buoys, the platform having a periphery that includes a plurality of attachment positions, one attachment position for each buoy.

Each of the buoys will move due to current and/or wind and/or wave action or due to other dynamic marine environmental factors. "Articulating connection" as used herein should be understood to mean any connection or joint that connects a buoy to the superstructure, transmits axial and shear forces, and allows the support buoy(s) to move relative to the superstructure without separation, and wherein the bending moment transferred to the superstructure from one of the so connected buoys or from multiple of the so connected buoys is reduced, minimized or substantially eliminated. "Articulating connection" is a joint movably connecting a buoy to a superstructure wherein axial and tangential forces are substantially transmitted, however, transfer of bending moment is substantially reduced or minimized through the joint allowing relative movement between the buoy and the superstructure.

An articulating connection connects each buoy to the platform at a respective attachment position, the connection allowing for sea state induced buoy motions while minimizing effects on the platform.

The apparatus of the present invention provides a marine platform that further comprises a mooring extending from a plurality of the buoys for holding the platform and buoys to a desired location.

In a preferred embodiment, the present invention provides a marine platform wherein each of the articulating connections includes corresponding concave and convex engaging portions. In another embodiment, a universal type joint is disclosed.

In another embodiment a marine platform has buoys with convex articulating portions and the platform has correspondingly shaped concave articulating portions.

In a preferred embodiment, each buoy can be provided with a concave articulating portion and the platform with a convex articulating portion.

In a preferred embodiment, each buoy has a height and a diameter. In a preferred embodiment, the height is much greater than the diameter for each of the buoys.

In the preferred embodiment, each buoy is preferably between 25 and 100 feet in diameter.

The apparatus of the present invention preferably provides a plurality of buoys, wherein each buoy is between about 100 and 500 feet in height.

The buoys can be of a generally uniform diameter along a majority of the buoy. However, each buoy can have a variable diameter in an alternate embodiment.

In a preferred embodiment, each buoy is generally cylindrically shaped. However, each buoy can be provided with simply an upper end portion that is generally cylindrically shaped.

In a preferred embodiment, there are at least three buoys and at least three attachment positions, preferably four buoys and four attachment positions.

In a preferred embodiment, each articulated connection is preferably hemispherically shaped for the upper end portion of each buoy and there is a correspondingly concavely shaped receptacle on the platform that fits the surface of each hemispherically shaped upper end portion.

In a preferred embodiment, the platform is comprised of a trussed deck. The trussed deck preferably has lower horizontal members, upper horizontal members and a plurality of inclined members spanning between the upper and lower horizontal members, and wherein the attachment positions are next to the lower horizontal member.

In a preferred embodiment, the apparatus supports an oil and gas well drilling and/or production platform weighing between 500 and 100,000 tons, more particularly, weighing between 3,000 tons and 50,000.

The apparatus of the present invention uses articulating connections between the submerged portion of the buoy and the superstructure to minimize or reduce topside, wave induced motions during the structural life of the apparatus.

The apparatus of the present invention thus enables smaller, multiple hull components to be used to support the superstructure than a single column or single buoy floater.

With the present invention, the topside angular motion is reduced and is less than the topside angular motion of a single column floater of comparable weight.

With the present invention, there is substantially no bending moment or minimum bending moment transferred between each buoy and the structure being supported. The present invention thus minimizes or substantially eliminates moment transfer at the articulating connection that is formed between each buoy and the structure being supported. The buoys are thus substantially free to move in any direction relative to the supported structure or load excepting motion that would separate a buoy from the supported structure.

The present invention has particular utility in the supporting of oil and gas well drilling facilities and oil and gas well drilling production facilities. The apparatus of the present invention has particular utility in very deep water, for example, in excess of 1500 feet.

The present invention also has particular utility in tropical environments (for example West Africa and Brazil) wherein the environment produces long period swell action.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 14 is rotated 90 degrees from FIG. 13 around the longitudinal axis of the buoy.

DETAILED DESCRIPTION OF THE INVENTION

Figure 1:
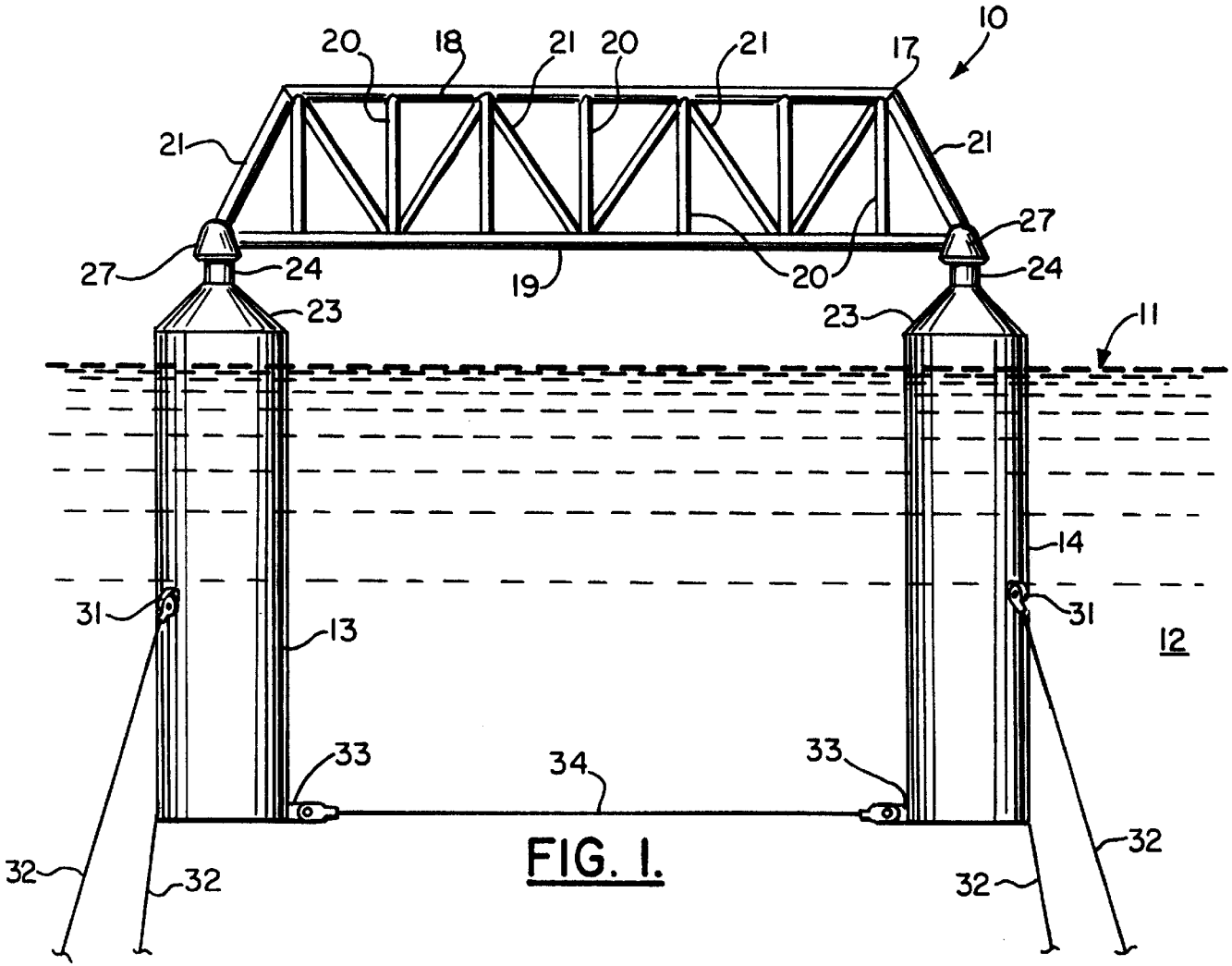
FIG. 1 is an elevation view of a preferred embodiment of the apparatus of the present invention.

FIGS. 1–6 show a preferred embodiment of the apparatus of the present invention designated generally by the numeral 10 in FIGS. 1–4. In FIGS. 1–4, floating marine platform apparatus 10 is shown in a marine environment or ocean 12 having a water surface 11. The apparatus 10 includes a plurality of buoys 13–16, preferably four (optionally between three (3) and eight (8)), that support a superstructure defined by the combination of platform 17 and drilling and/or producing facilities 53. Oil and gas well producing facility as used herein shall include a facility used for oil and gas well drilling or production, or a combination of drilling and production.

Buoys 13–16 can be any desired shape, including the alternate buoys shown in the drawings or buoys with configurations like those in the September 2000 issue of Offshore Magazine. Platform 17 can be any desired platform or rig, such as a trussed deck constructed of a plurality of upper horizontal members 18, a plurality of lower horizontal members 19, a plurality of vertical members 20 and a plurality of diagonal members 21 to define a trussed deck or platform 17. As shown in FIG. 1, platform 17 can include any desired oil and gas drilling and/or production facility 53, such facilities (in combination with platform 17) defining a superstructure weighing between about 500–100,000 tons, between 3,000–50,000 tons). (See FIGS. 3 and 8).

Figure 5:
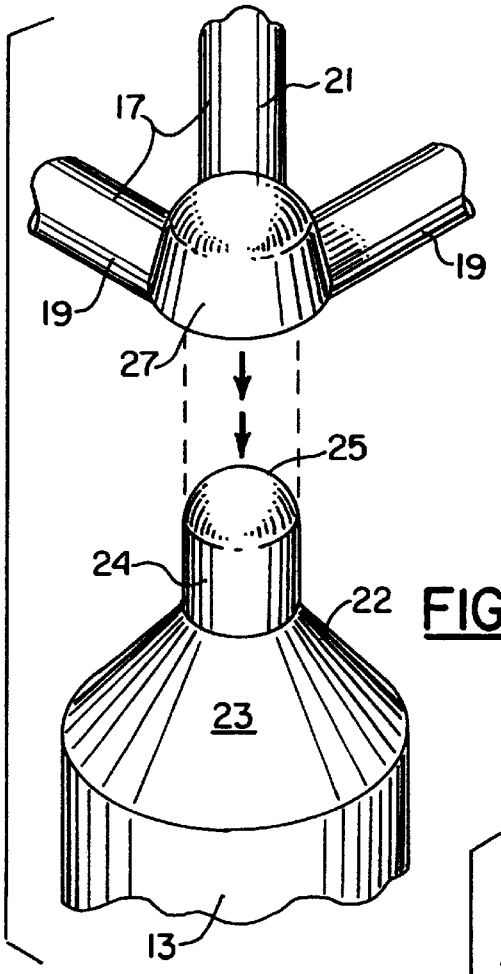
FIGS. 5–6 are fragmentary perspective views of the preferred embodiment of the apparatus of the present invention illustrating the articulating connection between a buoy and the platform.
Figure 6:
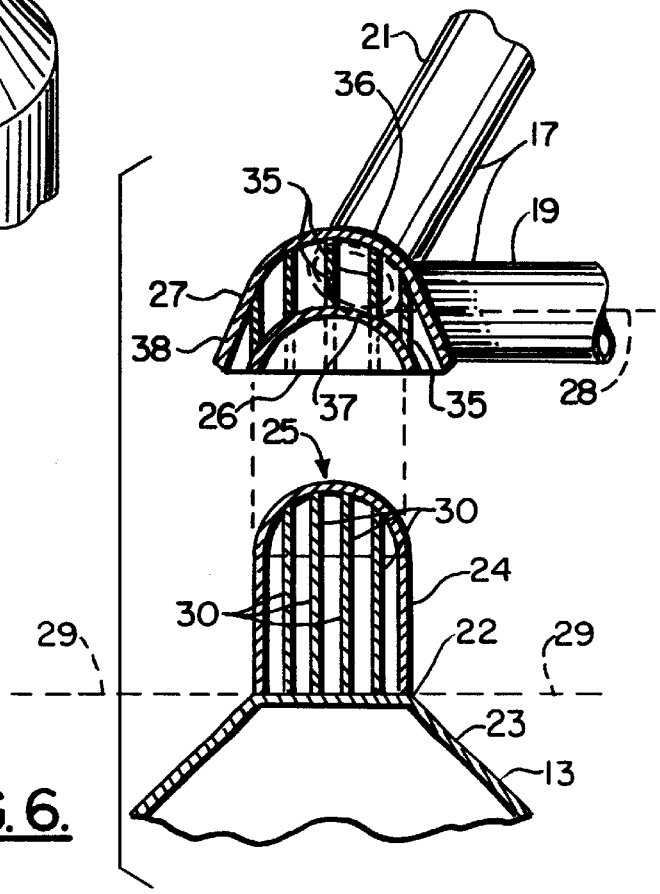

Each buoy 13–16 has an upper end portion 22 that can be conically shaped at 23 (see FIGS. 5–6). An attachment portion 27 provides a convex upper surface 25 that receives a correspondingly shaped concave surface 26 of connecting portion 27 of platform 17. The concave surface 26 can be generally hemispherically shaped. However, the concave surface 26 is curved to articulate upon the surface 25. Surface 26 is preferably smaller than a full hemispherical surface, sized to articulate upon surface 25 even wherein there is an angular variation that can be as much as 30 degrees (or more) between the central longitudinal axis 29 of horizontal member 19 of platform 17 and a pure horizontal plane. To address wear, bearing materials may be used in the articulating connections which are conventionally available. A preferred bearing material would be graphite impregnated brass or bronze bushing.

As an example, the following equations can be used in sizing buoys of uniform cylindrical cross-section (however, buoys with other than cylindrical cross sections and/or varying cross sections can be sized by those skilled in the art using appropriate formulas for said configurations):

$$\text{Heave Period T(heave)}=2\pi\sqrt{(M/K)}$$

Where

M=total Heave mass;

K=Heave stiffness;

$$\text{Heave Stiffness } K=\tfrac{1}{4}\pi D^2 G$$

Where

D=the diameter of the section of the buoy passing through the water plane;

G=the unit weight of water (approximately 65 pounds per cubic foot);

$$\text{Heave Mass } M=(\text{Dry buoy mass})+(\text{entrapped fluid mass})+(\text{permanent solid ballast mass})+(\text{added virtual fluid mass})$$

The buoys may be constructed of stiffened steel plate, or continuously cast (slip formed) concrete or through other conventional construction techniques. Typically, a number of internal stiffeners are included to provide the required overall structural strength.

The attachment portion 24 at the upper end of each buoy 13–16 can be reinforced with a plurality of vertical plates 30 as shown in FIG. 6. Likewise, the connection portion 27 of platform 17 can be provided with a plurality of internal reinforcing plates 35. The plates 35 extend between upper curved plate 36 and lower curved plate 37. A conical plate 38 can be attached to (or can be integral with) upper curved plate 36 as shown in FIG. 6. A square harness articulating connection (not shown) going around the primary articulating connection may also be used.

Platform apparatus 10 can be secured to the sea bed 51 using piling or anchors 52 and mooring lines 32, 41 (FIGS. 1–4, 8). In a preferred embodiment (FIGS. 1–4), one or more mooring lines 32 extend from each buoy 13–16 at an upper padeye 31 to the sea bed 51. The mooring lines in FIGS. 1, 2, 3 and 4 extend between padeyes 31 and anchors 52 at sea bed 51.

In a preferred embodiment, a plurality of horizontal mooring lines 34 extend between lower padeyes 33 on two buoys 13, 14 as shown in FIG. 1. While the lower horizontal mooring lines 34 are shown connecting to buoys 13, 14, it should be understood that each pair of buoys (14–15, 15–16, 16–13) has a horizontal line 34 extending there between in the same configuration shown in FIG. 1.

Figure 7:
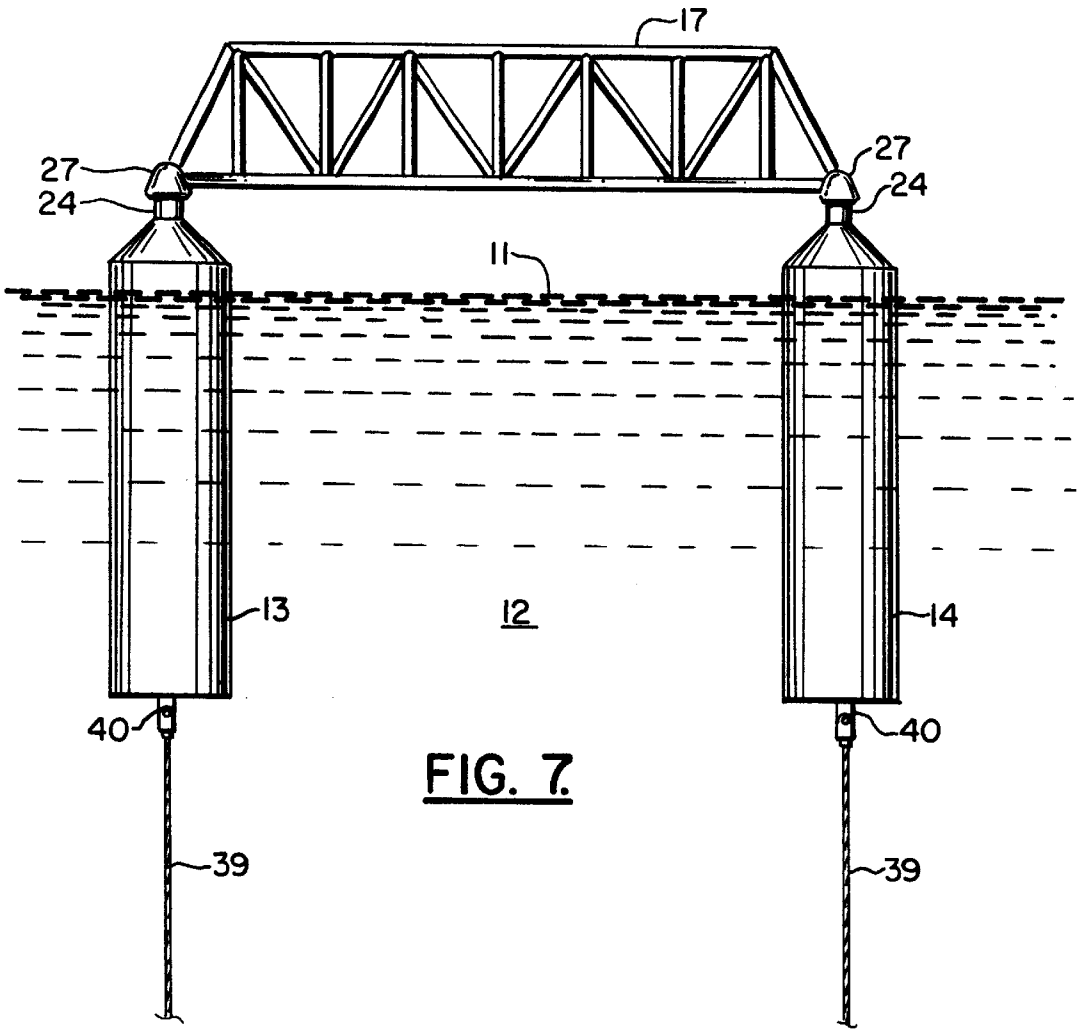
FIGS. 7–8 show alternate mooring arrangements for the apparatus of the present invention.

FIG. 7 shows a first alternate embodiment of the present invention, utilizing tensioned mooring lines 39 that extend between connection points (eg. padeyes) 40 on each of the buoys 13–16 and anchors (such as 52) embedded in the sea bed 51. In the embodiment of FIG. 7, horizontal mooring lines 34 could optionally be provided between each pair of buoys such as 13 and 14, or 14 and 15, or 15 and 16, or 6 and 13.

Figure 8:
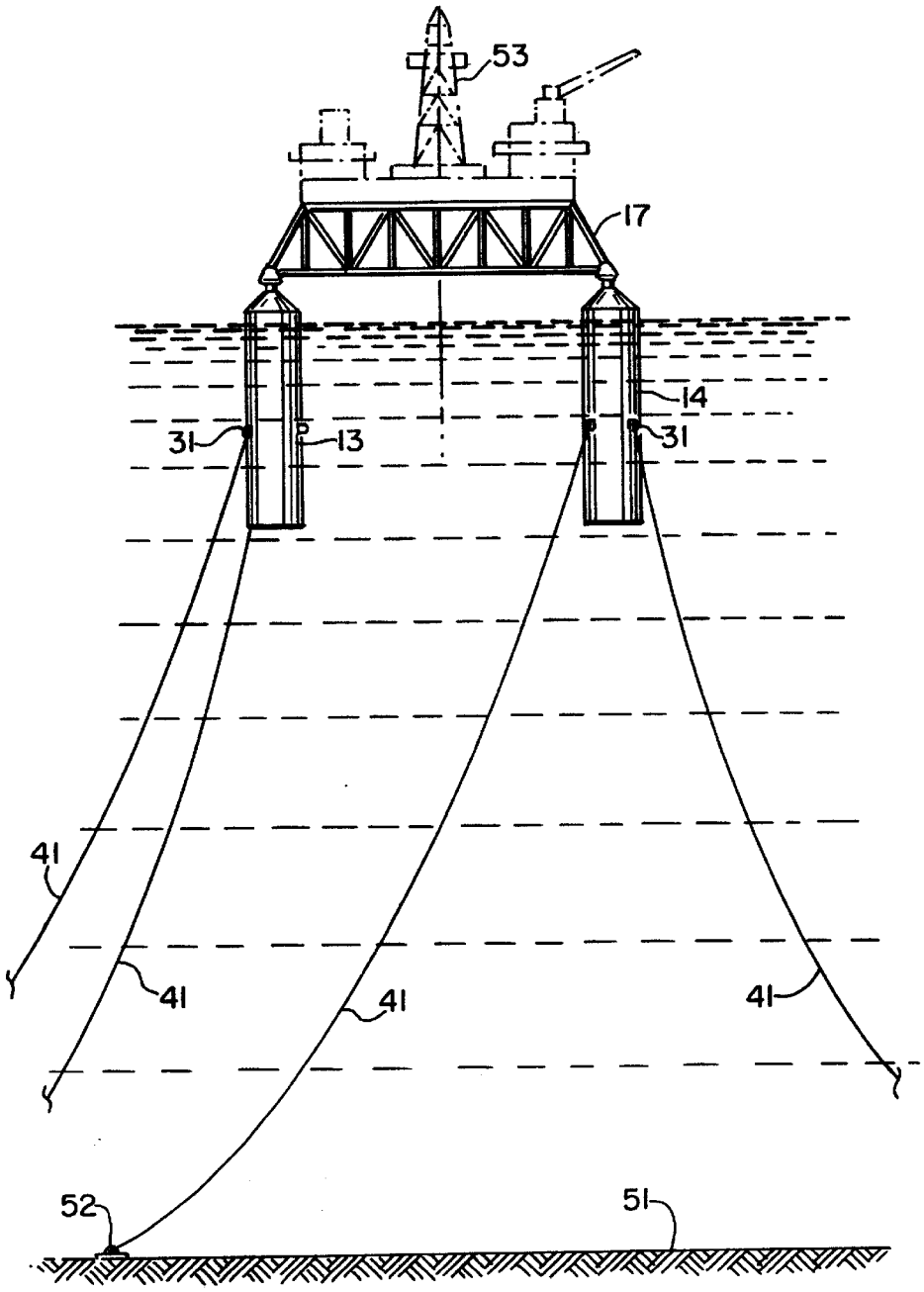

FIG. 8 shows an alternate arrangement wherein caternary mooring lines 41 extend between padeyes 31 and the anchors 52 that are anchored to the sea bed 51.

Figure 2:
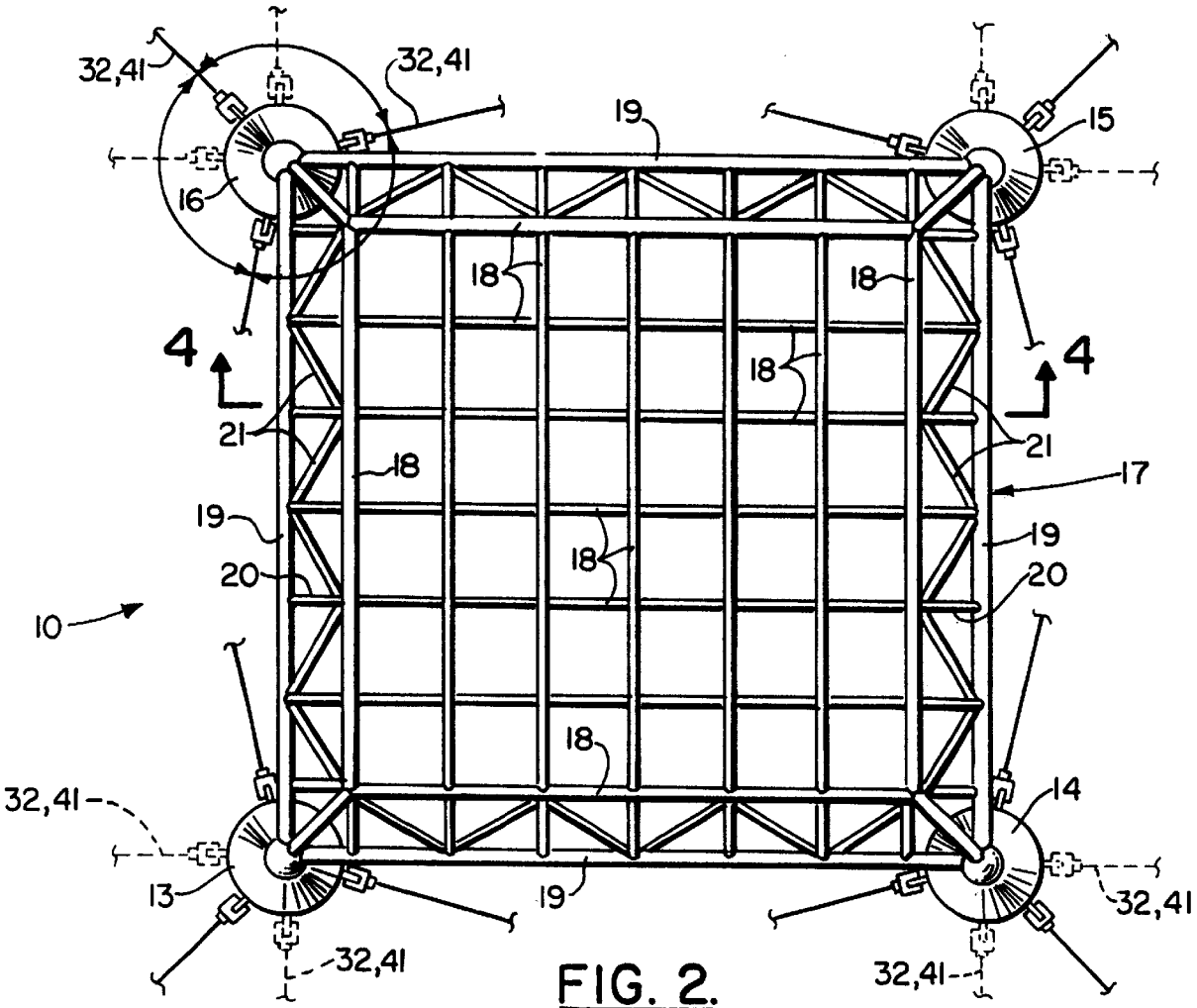
FIG. 2 is a plan view of a preferred embodiment of the apparatus of the present invention.
Figure 3:
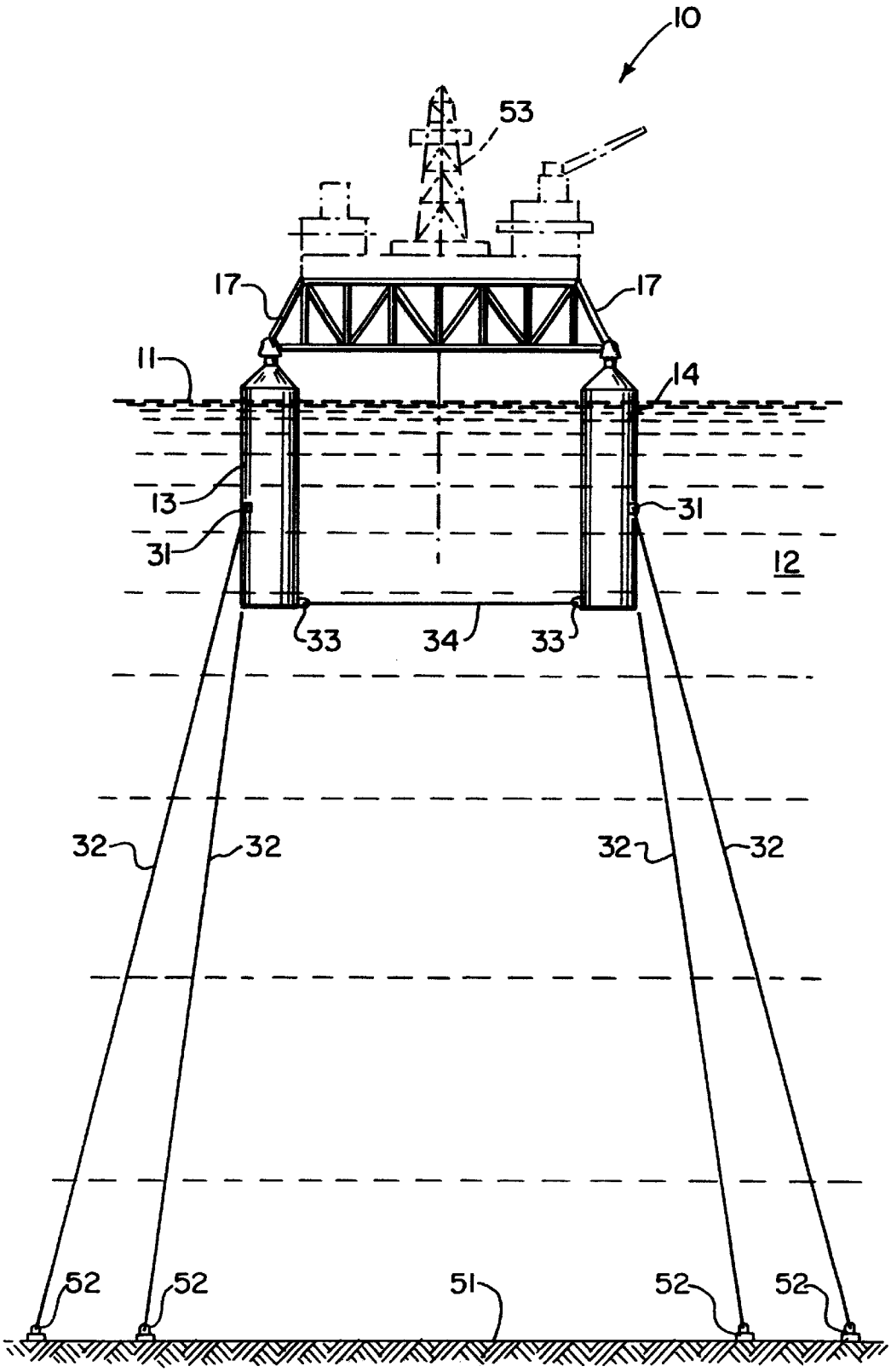
FIG. 3 is another elevation view of a preferred embodiment of the apparatus of the present invention.
Figure 4:
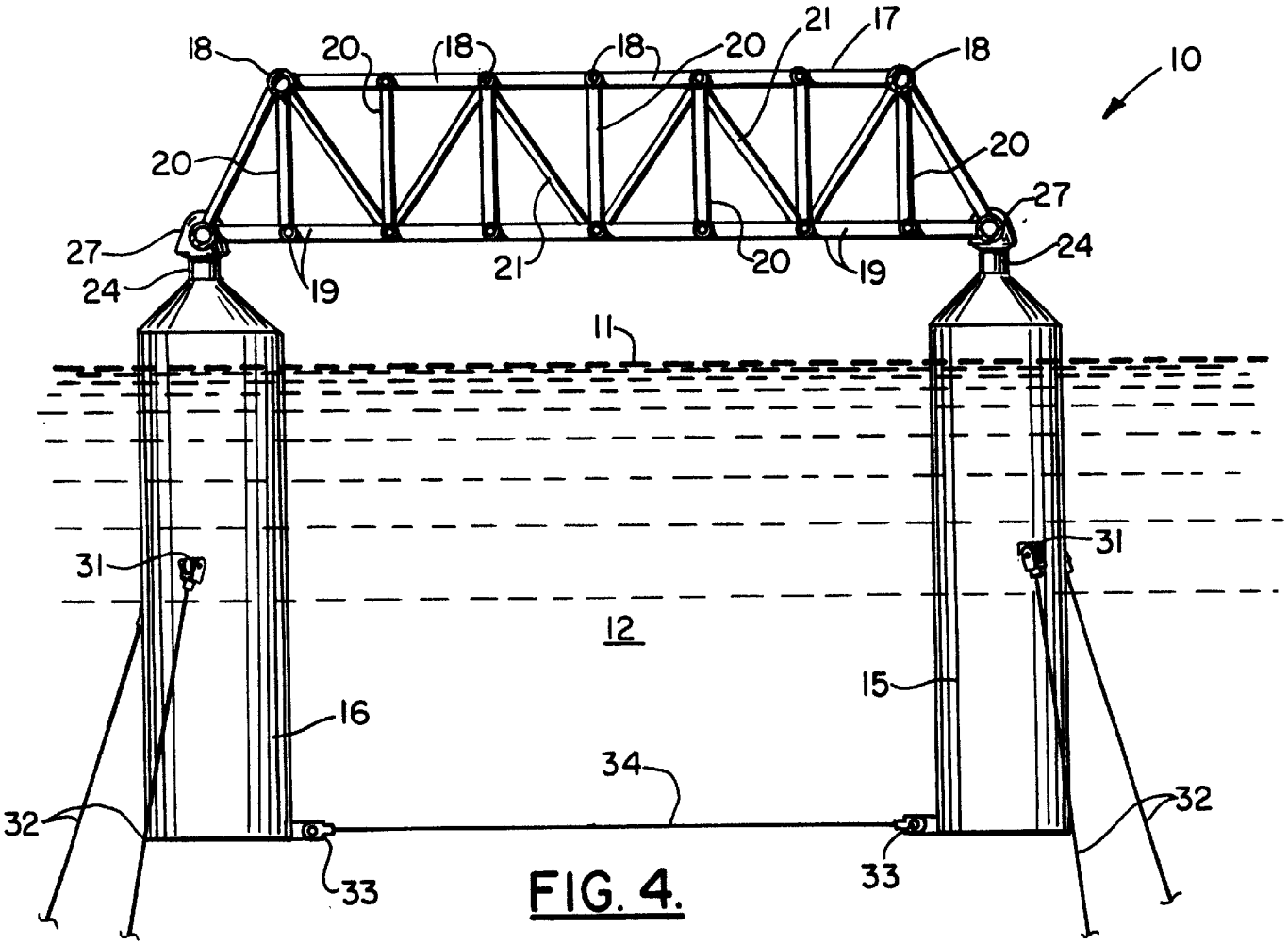
FIG. 4 is a sectional view taken along lines 4—4 of FIG. 2.

The plan view of FIG. 2 shows various orientations that could be used for either mooring lines 32 or mooring lines 41. One arrangement provides a plurality of three mooring lines 32 or 41 attached to each buoy 13–16, the mooring lines 32 or 41 being spaced about 120 degrees apart as shown in hard lines. In phantom lines in FIG. 2, another geometry for the mooring lines 32, 41 is shown, wherein there are two mooring lines for each buoy that are about 90 degrees apart.

The platform A constructed of upper and lower sets of horizontal members 18, 19; vertical members 20; and diagonal members 21.

Figure 9:
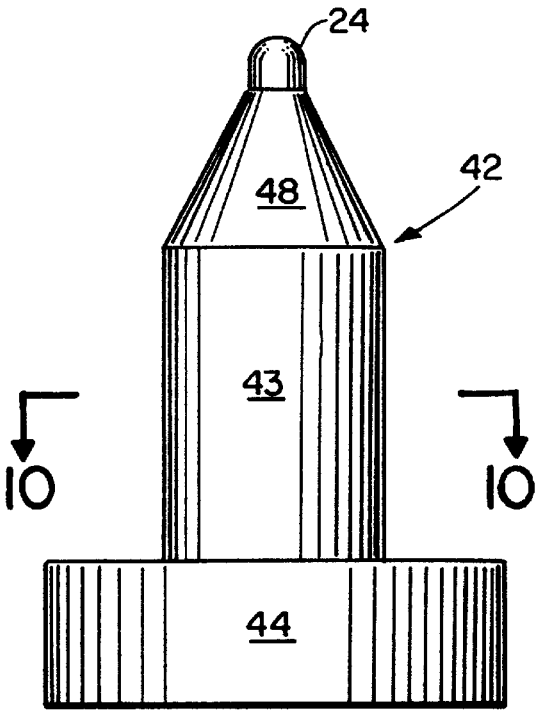
FIG. 9 is a partial elevation view of an alternate embodiment of the apparatus of the present invention that features buoys of variable diameter.
Figure 10:
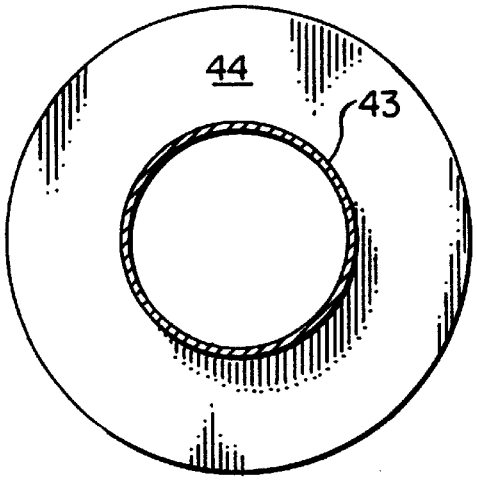
FIG. 10 is a sectional view taken along lines 10—10 of FIG. 9.
Figure 10A:
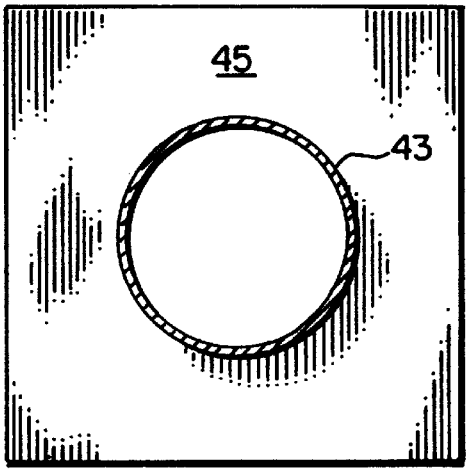
FIG. 10A is a sectional view taken along lines 10—10 of FIG. 9 and showing a buoy lower end portion that is square.

FIGS. 9, 10 and 10A show an alternate construction for each of the buoys. It should be understood that a buoy such as one of those shown in FIGS. 9, 10 or 10A could be used to replace any one or all of the buoys 13–16 shown in FIGS. 1–4 and 5–6.

Buoy 42 can be provided with a variable diameter having a smaller diameter cylindrical middle section 43, and a larger diameter lower section 44 which can be for example, either cylindrical (See FIG. 10) or squared (see FIG. 10A). The cylindrical lower section 44 is shown in FIGS. 9 and 10, and the squared lower section 45 shown in FIG. 10A.

Figure 11:
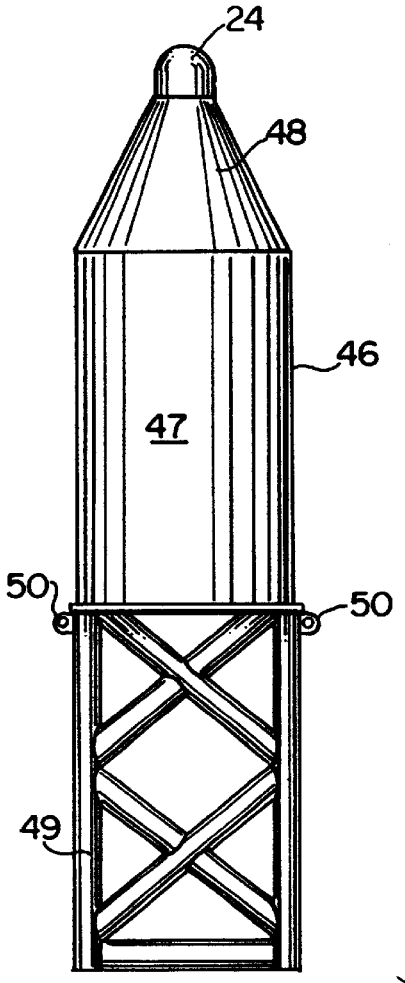
FIG. 11 is a partial elevation view of a third embodiment of the apparatus of the present invention showing an alternate buoy construction.
Figure 12:
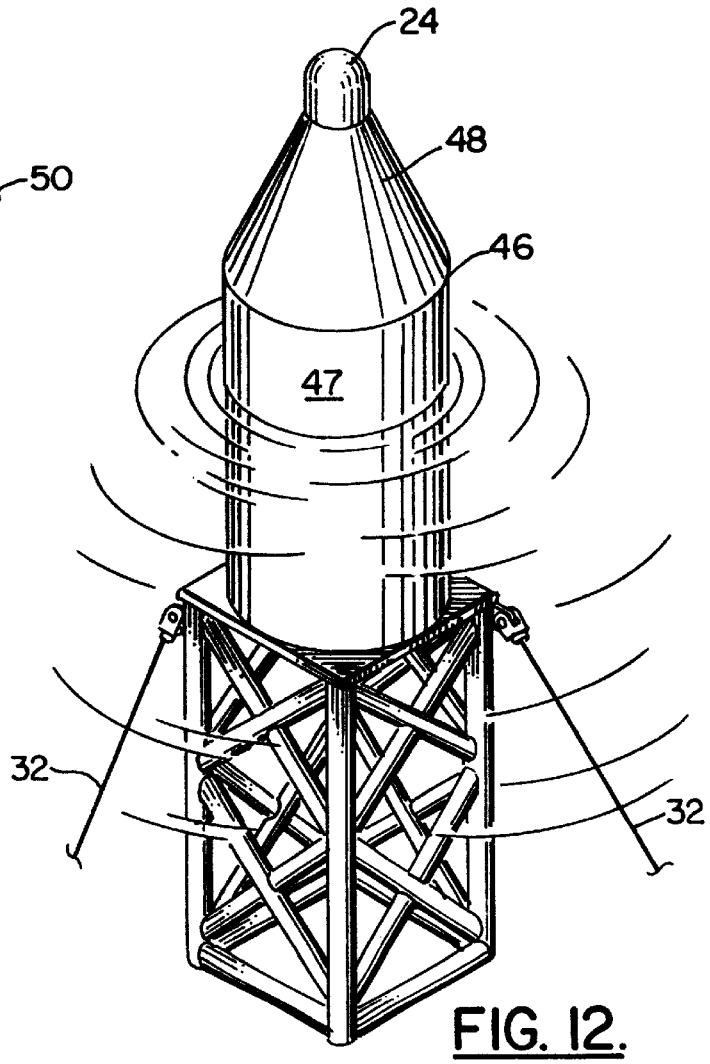
FIG. 12 is a perspective elevation view of a third embodiment of the apparatus of the present invention showing an alternate buoy construction.

Another buoy construction is shown in FIGS. 11 and 12. It should be understood that the buoy shown in FIG. 11 and 12 could be used to replace any one or all of the plurality of buoys 13–16 of FIGS. 1–6. In FIGS. 11 and 12, the buoy 46 has a cylindrical middle section 47, a conical upper section 48, and a trussed lower section 49. Padeyes 50 on the upper end portion of trussed lower section 49 can be used to support any of the afore described mooring lines such as 32, 39, or 41. In the embodiment of FIGS. 11 and 12, each of the buoys 46 can have a similar construction and configuration at the upper end portion to that of a preferred embodiment shown in FIGS. 1–6, providing a conical upper section 48 and a attachment portion 24.

Figure 14:
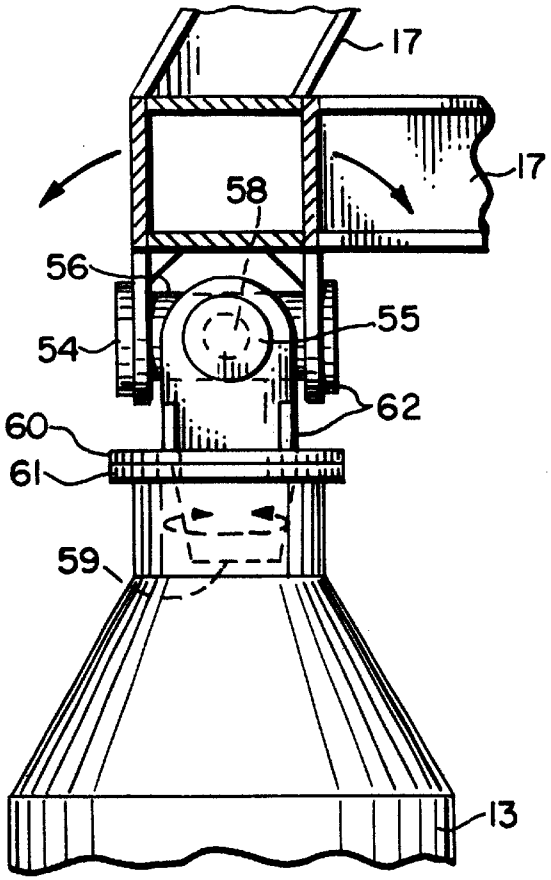
FIGS. 13–14 are elevation views of a fourth embodiment of the apparatus of the present invention showing an alternate articulating connection between each buoy and the platform.
Figure 13:
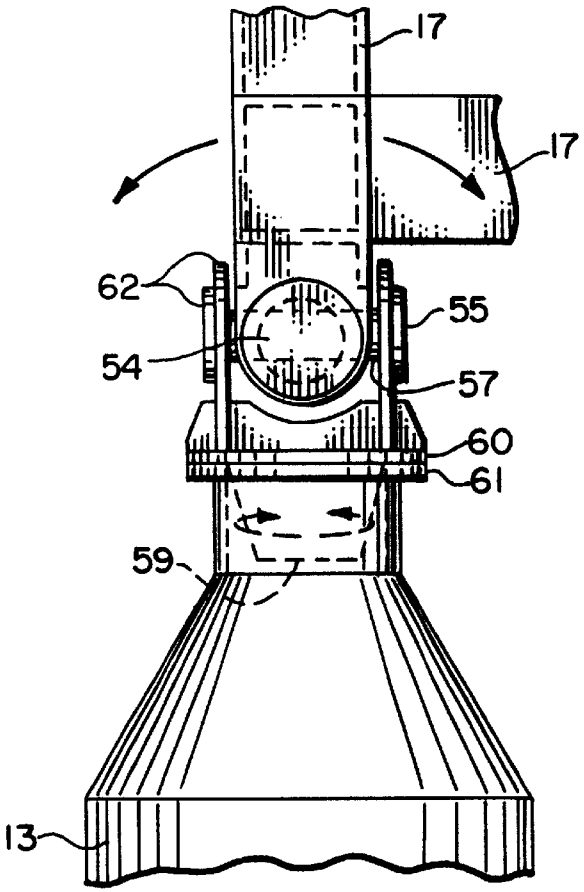

In FIGS. 13 and 14, there can be seen an alternate articulating connection between platform 17 and a selected buoy 13 (or 14–16 or 42, or 46). A gimble or universal joint 62 arrangement is shown in FIGS. 13 and 14, providing a first pinned connection at 54 and a second pinned connection at 55. The first pin 56 can be of a larger diameter, having a central opening 58 through which the second, smaller diameter pin 57 passes as shown. The central longitudinal axes of the pins 54, 55 preferably intersect arrow 59 in FIGS. 13–14 shows that a buoy can optionally be made to rotate relative to the gimbal connection shown. Bearing plates 60, 61 can rotate relative to one another. To minimize frictional force transference and wear, both pins can be mounted in bearings.

Each of the buoys will move due to current and/or wind and/or wave action or due to other dynamic marine environmental factors. "Articulating connection" as used herein should be understood to mean any connection or joint that connects a buoy to the superstructure, transmits axial and shear forces, and allows the support buoy(s) to move relative to the superstructure without separation, and wherein the bending moment transferred to the superstructure from one of the so connected buoys or from multiple of the so connected buoys is reduced, minimized or substantially eliminated.

PARTS LIST

| PART NUMBER | DESCRIPTION |
|---|---|
| 10 | floating marine platform apparatus |
| 11 | water surface |
| 12 | ocean |
| 13 | buoy |
| 14 | buoy |
| 15 | buoy |
| 16 | buoy |
| 17 | platform |
| 18 | upper horizontal member |
| 19 | lower horizontal member |
| 20 | vertical member |
| 21 | diagonal member |
| 22 | upper end portion |
| 23 | conical shape |
| 24 | attachment portion |
| 25 | convex surface |
| 26 | concave surface |
| 27 | connecting portion |
| 28 | central longitudinal axis |
| 29 | axis |
| 30 | internal reinforcing plate |
| 31 | upper padeye |
| 32 | mooring line |
| 33 | lower padeye |
| 34 | horizontal mooring line |
| 35 | internal reinforcing plate |
| 36 | upper curved plate |
| 37 | lower curved plate |
| 38 | conical plate |
| 39 | tensioned mooring line |
| 40 | padeye |
| 41 | caternary mooring line |
| 42 | buoy |
| 43 | cylindrical middle section |
| 44 | cylindrical lower section |
| 45 | square lower section |
| 46 | buoy |
| 47 | cylindrical middle section |
| 48 | conical upper section |
| 49 | trussed lower section |
| 50 | padeye |
| 51 | sea bed |
| 52 | anchor |
| 53 | drilling/production facility |
| 54 | first pinned connection |
| 55 | second pinned connection |
| 56 | pin |
| 57 | pin |
| 58 | opening |
| 59 | arrow |
| 60 | bearing plate |
| 61 | bearing plate |
| 62 | universal joint |

The foregoing embodiments, are presented by way of example only; the scope of the present invention is to be limited only by the following claims.

What is claimed is:

1. A marine platform, comprising:

a) a plurality of individual buoys;

b) a platform structure having an oil and gas well, producing facility and a peripheral portion that includes a plurality of connecting positions one connecting position for each bouy;

c) a plurality of articulating connections, including a different articulating connection connecting each buoy to the platform at a respective connecting position, each articulating connection allowing for buoy motions induced by sea movement between a buoy and the platform structure while reducing sea movement effect on the platform; and wherein the separate articulating connections enable movement of each one of the buoys relative to the platform structure so that axial and tangential forces between the platform and each buoy is transmitted, while transfer of bending movement is reduced or minimized.

2. The marine platform of claim 1 further comprising a mooring extending from a plurality of the buoys for holding the platform and buoys to a desired location.

3. The marine platform of claim 1 wherein the articulating connections are universal joints.

4. The marine platform of claim 1 wherein each of the articulating connections includes correspondingly concave and convex portions.

5. The marine platform of claim 4 wherein at least one buoy has a convex articulating portion and the platform has at least one concave articulating portion, the at least one convex articulating portion and the at least one concave articulating portion forming at least one articulating connection of the plurality of articulating connections.

6. The marine platform of claim 4 wherein at least one buoy has a concave articulating portion and the platform has at least one convex articulating portion, the at least one concave articulating portion and the at least one convex articulating portion forming at least one articulating connection of the plurality of articulating connections.

7. The marine platform of claim 1 wherein each buoy has a height and a diameter, the height being greater than the diameter.

8. The marine platform of claim 1 wherein there are at least three buoys and at least three connecting positions.

9. The marine platform of claim 1 wherein there are at least four buoys and at least four connecting positions.

10. The marine platform of claim 1 wherein there are between 3 and 8 connecting positions.

11. The marine platform of claim 1 wherein the platform is comprised of a trussed deck.

12. The marine platform of claim 1 wherein the trussed deck has lower horizontal members, upper horizontal members, and a plurality of inclined members spanning between the upper and lower horizontal members, and wherein the connecting positions are next to the lower horizontal members.

13. The marine platform of claim 1 wherein each buoy is between 100 and 500 feet in height.

14. The marine platform of claim 1 wherein each buoy is between about 25 and 100 feet in diameter.

15. The marine platform of claim 1 wherein each buoy has a generally uniform diameter over a majority of its length.

16. The marine platform of claim 1 wherein each buoy has an upper end portion that is generally cylindrically shaped.

17. The marine platform of claim 1 wherein at least one articulated connection is comprised of a buoy with a hemispherically shaped upper end and a correspondingly shaped concave receptacle on the platform that fits the hemispherically shaped upper end.

18. The marine platform of claim 1 wherein the buoys support a platform that weighs between 500 and 100,000 tons.

19. A marine platform, comprising:

a) a plurality of individual buoys;

b) a platform superstructure having an oil and gas well producing facility weighing between 500 tons and 100,000 tons and a peripheral portion that includes a plurality of connecting positions, one connecting position for each buoy;

c) a plurality of articulating connections, a separate articulating connections connecting each buoy to the platform superstructure at a respective connecting position, the plurality of articulating connections allowing for buoy motions induced by sea movement while reducing sea movement effect on the platform superstructure; and d) wherein each articulating connection is a separate joint movably connecting a buoy to the platform superstructure, and wherein axial and tangential forces are substantially transmitted without transfer of substantial bending movement, allowing relative movement between each buoy and the superstructure.

20. The marine platform of claim 18 further comprising a mooring extending from a plurality of the buoys for holding the platform and buoys to a desired location.

21. The marine platform of claim 19 wherein the articulating connections are universal joints.

22. The marine platform of claim 19 wherein each of the articulating connections includes correspondingly concave and convex engaging portions.

23. The marine platform of claim 19 wherein at least one buoy has a convex articulating portion and the platform has at least one concave articulating portion, the at least one convex articulating portion and the at least one concave articulating portion forming at least one articulating connection of the plurality of articulating connections.

24. The marine platform of claim 19 wherein at least one buoy has a concave. articulating portion and the platform has at least one convex articulating portion, the at least one concave articulating portion and the at least one convex articulating portion forming at least one articulating connection of the plurality of articulating connections.

25. The marine platform of claim 19 wherein each buoy has a height and a diameter, the height being greater than the diameter.

26. The marine platform of claim 19 wherein there are at least three buoys and at least three connecting positions.

27. The marine platform of claim 19 wherein there are at least four buoys and at least four connecting positions.

28. The marine platform of claim 19 wherein the platform is comprised of a trussed deck.

29. The marine platform of claim 19 wherein the trussed deck has lower horizontal members, upper horizontal members, and a plurality of inclined members spanning between the upper and lower horizontal members, and wherein the connecting positions are next to the lower horizontal members.

30. The marine platform of claim 19 wherein each buoy is between 100 and 500 feet in height.

31. The marine platform of claim 19 wherein each buoy is between about 25 and 100 feet in diameter.

32. The marine platform of claim 19 wherein each buoy has a generally uniform diameter over a majority of its length.

33. The marine platform of claim 19 wherein each buoy has an upper end portion that is generally cylindrically shaped.

34. The marine platform of claim 19 wherein at least one articulated connection is comprised of a buoy with a hemispherically shaped upper end and a correspondinly shaped concave receptacle on the platform that fits the hemispherically shaped upper end.

35. A marine platform, comprising:

a) a plurality of individual buoys;

b) a platform superstructure having an oil and gas well producing facility and a peripheral portion that includes a plurality of connecting positions, one connecting position for each buoy;

c) a plurality of articulating connections, one of the articulating connections connecting a said individual buoy to the platform superstructure at a respective connecting position, each articulating connection allowing for buoy motion induced by sea movement while reducing sea movement effect on the platform superstructure; and d) wherein each articulating connection is a separate joint movably connecting a said buoy to the platform superstructure, and wherein axial and tangential forces are substantially transmitted without transfer of substantial bending moment, allowing relative movement between each buoy and the superstructure.

36. The marine platform of claim 35 further comprising a mooring extending from a plurality of the buoys for holding the platform and buoys to a desired location.

37. The marine platform of claim 35 wherein the articulating connections are universal joints.

38. The marine platform of claim 35 wherein each of the articulating connections includes correspondingly concave and convex engaging portions.

39. The marine platform of claim 38 wherein at least one buoy has a convex articulating portion and the platform has at least one concave articulating portion, the at least one convex articulating portion and the at least one concave articulating portion forming at least one articulating connection of the plurality of articulating connections.

40. The marine platform of claim 38 wherein at least one buoy has a concave articulating portion and the platform has at least one convex articulating portion, the at least one concave articulating portion and the at least one convex articulating portion forming at least one articulating connection of the plurality of articulating connections.

41. The marine platform of claim 35 wherein each buoy has a height and a diameter, the height being greater than the diameter.

42. The marine platform of claim 35 wherein there are at least three buoys and at least three connecting positions.

43. The marine platform of claim 35 wherein there are at least four buoys and at least four connecting positions. four connecting positions.

44. The marine platform of claim 35 wherein there are between 3 and 8 connecting positions.

45. The marine platform of claim 35 wherein the platform is comprised of a trussed deck.

46. The marine platform of claim 35 wherein the trussed deck has lower horizontal members, upper horizontal members, and a plurality of inclined members spanning between the upper and lower horizontal members, and wherein the connecting positions are next to the lower horizontal members.

47. The marine platform of claim 35 wherein each buoy is between 100 and 500 feet in height.

48. The marine platform of claim 35 wherein each buoy is between about 25 and 100 feet in diameter.

49. The marine platform of claim 35 wherein each buoy has a generally uniform diameter over a majority of its length.

50. The marine platform of claim 35 wherein each buoy has an upper end portion that is generally cylindrically shaped.

51. The marine platform of claim 35 wherein at least one articulated connection is comprised of a buoy with a hemispherically shaped upper end and a correspondingly shaped concave receptacle on the platform that fits the hemispherically shaped upper end.

52. The marine platform of claim 35 wherein the buoys support a platform that weighs between 500 and 100,000 tons.

53. A marine platform, comprising:

a) a plurality of individual buoys;

b) a platform superstructure that includes an oil and gas well producing facility weighing between 500 tons and 100,000 tons and a peripheral portion that includes a plurality of connecting positions, one connecting position for each buoy;

c) a plurality of articulating connections, respective articulating connections connecting the plurality of buoys to the platform at different respective connecting positions, the plurality of articulating connections allowing for buoy motions induced by sea movement while reducing sea movement effect on the platform; and d) wherein each articulating connection is a separate joint movably connecting a said buoy to the platform superstructure, and wherein axial and tangential forces are substantially transmitted without transfer of substantial bending moment, allowing relative movement between each buoy and the superstructure.

54. The marine platform of claim 53 further comprising a mooring extending from a plurality of the buoys for holding the platform and buoys to a desired location.

55. The marine platform of claim 53 wherein the articulating connections are universal joints.

56. The marine platform of claim 53 wherein each of the articulating connections includes correspondingly concave and convex engaging portions.

57. The marine platform of claim 53 wherein at least one buoy has a convex articulating portion and the platform has at least one concave articulating portion, the at least one convex articulating portion and the at least one concave articulating portion forming at least one articulating connection of the plurality of articulating connections.

58. The marine platform of claim 53 wherein at least one buoy has a concave articulating portion and the platform has at least one convex articulating portion, the at least one concave articulating portion and the at least one convex articulating portion forming at least one articulating connection of the plurality of articulating connections.

59. The marine platform of claim 53 wherein each buoy has a height and a diameter, the height being greater than the diameter.

60. The marine platform of claim 53 wherein there are at least three buoys and at least three connecting positions.

61. The marine platform of claim 53 wherein there are at least four buoys and at least four connecting positions.

62. The marine platform of claim 53 wherein the platform is comprised of a trussed deck.

63. The marine platform of claim 53 wherein the trussed deck has lower horizontal members, upper horizontal members, and a plurality of inclined members spanning between the upper and lower horizontal members, and wherein the connecting positions are next to the lower horizontal members.

64. The marine platform of claim 53 wherein each buoy is between 100 and 500 feet in height.

65. The marine platform of claim 53 wherein each buoy is between about 25 and 100 feet in diameter.

66. The marine platform of claim 53 wherein each buoy has a generally uniform diameter over a majority of its length.

67. The marine platform of claim 53 wherein each buoy has an upper end portion that is generally cylindrically shaped.

68. The marine platform of claim 53 wherein at least one articulated connection is comprised of a buoy with a hemispherically shaped upper end and a correspondingly shaped cave receptacle on the platform that fits the hemispherically shaped upper end.

* * * * *